US009381763B2

(12) United States Patent
Rius Rossell

(10) Patent No.: US 9,381,763 B2
(45) Date of Patent: Jul. 5, 2016

(54) NOZZLE CALIBRATION

(71) Applicant: Hewlett-Packard Development Company, L.P., Houston, TX (US)

(72) Inventor: Marti Rius Rossell, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/762,801

(22) PCT Filed: Jan. 29, 2013

(86) PCT No.: PCT/EP2013/051646
§ 371 (c)(1),
(2) Date: Jul. 22, 2015

(87) PCT Pub. No.: WO2014/117808
PCT Pub. Date: Aug. 7, 2014

(65) Prior Publication Data
US 2015/0360492 A1 Dec. 17, 2015

(51) Int. Cl.
*B41J 29/393* (2006.01)
*B41J 2/045* (2006.01)

(52) U.S. Cl.
CPC ..... *B41J 29/393* (2013.01); *B41J 2/0458* (2013.01); *B41J 2/04536* (2013.01)

(58) Field of Classification Search
CPC ..... B41J 2/04535; B41J 2/04536; B41J 2/04506; B41J 2/165; B41J 2/16585; B41J 2/2142; B41J 2/2146; B41J 2/245; B41J 29/393; B41J 29/395
USPC ..... 347/13, 14, 19, 23
See application file for complete search history.

(56) References Cited

U.S. PATENT DOCUMENTS

| | | | |
|---|---|---|---|
| 5,036,337 | A | 7/1991 | Rezanka |
| 6,840,597 | B1 | 1/2005 | Wilson et al. |
| 7,296,882 | B2 | 11/2007 | Buehler et al. |
| 8,292,400 | B2 | 10/2012 | Garcia et al. |
| 8,529,011 | B2 | 9/2013 | Govyadinov |

(Continued)

FOREIGN PATENT DOCUMENTS

| | | |
|---|---|---|
| GB | 2404767 | 2/2005 |
| TW | 200940347 | 10/2009 |

OTHER PUBLICATIONS

Choi, Jaeyong, et al. "Drop-on-demand printing of conductive ink by electrostatic field induced inkjet head." Applied Physics Letters 93.19 (2008): 193508.

(Continued)

*Primary Examiner* — Julian Huffman
*Assistant Examiner* — Sharon A Polk
(74) *Attorney, Agent, or Firm* — HP Inc. Patent Department

(57) ABSTRACT

An apparatus and method for use in generating calibration parameters for an inkjet nozzle are disclosed. The method comprises obtaining data defining how calibration parameters associated with a nozzle change as the number of ink drops ejected from a nozzle increases, determining a number of ink drops ejected from the nozzle, and adjusting calibration parameters for the nozzle based on the determined number of ink drops ejected from the nozzle and the obtained data defining how calibration parameters associated with a nozzle change as the number of ink drops ejected from a nozzle increases.

14 Claims, 5 Drawing Sheets

(56) References Cited

U.S. PATENT DOCUMENTS

2003/0016258 A1 1/2003 Anderson et al.
2003/0189612 A1* 10/2003 Darby ..... B41J 29/393 347/19
2006/0077407 A1* 4/2006 Tanaka ..... H04N 1/6055 358/1.9
2006/0227157 A1* 10/2006 Drake ..... B41J 29/393 347/13
2008/0225072 A1* 9/2008 Klees ..... B41J 2/125 347/19
2009/0244163 A1* 10/2009 Govyadinov ..... B41J 2/0456 347/19
2012/0075378 A1 3/2012 Baldy, Jr. et al.
2012/0194833 A1 8/2012 Hara et al.

OTHER PUBLICATIONS

International Search Report, European Patent Office, Oct. 21, 2013, PCT Patent Application No. PCT/EP2013/051646.

* cited by examiner

NOZZLE CALIBRATION

CROSS-REFERENCE TO RELATED APPLICATION

This application is a U.S. National Stage Application of and claims priority to International Patent Application No. PCT/EP2013/051646, filed on Jan. 29, 2013, and entitled "NOZZLE CALIBRATION," which is hereby incorporated by reference in its entirety.

BACKGROUND

Inkjet printers print dots on a print medium by ejecting small drops of ink from one or more nozzles. In order to ensure consistent color reproduction in an image built up on the print medium from a large number of drops of ink, it is important that portions of the image printed by different nozzles have equivalent colorimetry. This can be achieved by ensuring that the amount of ink present in each drop is the same for each drop ejected from all of the nozzles. Alternatively, for print elements that are found to eject smaller drops, the average number of drops ejected by that print element may be increased.

However, the amount of ink present in each ejected drop may vary due to slight differences between nozzles, due to changes in the ink being used, or for other reasons. A calibration process may be performed at regular intervals in order to determine colorimetry of the printer output as compared to a desired reference. The calibration process allows the control signals provided to each nozzle, or portion of a printhead to be adjusted such that the output is corrected for any variation that has occurred. This may be achieved by modifying the control signals directly based on calibration parameters, or by altering the image data to be printed to take account of variations in the response of the nozzles being used to print the image.

While regular re-calibration of the nozzles in an inkjet printer can ensure consistency for colors printed across a print medium, and for a series of print media, performing the calibration process wastes a certain amount of print media and ink. Furthermore, it has been found that requiring a user to perform regular calibration of the inkjet printer gives the user a perception that the printer may be unreliable.

BRIEF INTRODUCTION OF THE DRAWINGS

Embodiments of the present invention are further described hereinafter by way of example only with reference to the accompanying drawings, in which.

DETAILED DESCRIPTION OF AN EXAMPLE

Examples provide a way to guarantee color uniformity in an image printed using an inkjet printer, while reducing the frequency of performing a calibration process for the nozzles of the inkjet printer.

It has been observed that maintaining color uniformity across a printed image is particularly important for printers using a Page Wide Array (PWA) printbar. In such printers, a printbar having an array of inkjet nozzles spanning the width of a print zone is used, as opposed to more common inkjet printer systems in which a print head is scanned across the print medium. Printbars can enable higher throughput of the printer, but may present particular difficulties in ensuring consistent color reproduction across the whole width of the nozzle array, which may be fabricated from a number of individual dies packaged together.

One factor that can result in changes of the drop size ejected by the nozzle is the usage of the nozzle, i.e. the total number of drops that have been ejected from a particular nozzle. This is because increased nozzle usage tends to decrease the drop weight, which in turn results in lighter colors being printed. This is particularly relevant to PWA printers that print pages of different sizes, as depending upon the page size some nozzles of the page wide array are used more than others, which in turn causes bands of different color densities when a larger media is printed. This effect can also occur after printing a series of print media including a block of color that spans only a portion of the printbar, leading to heavy usage of nozzles in that portion.

Figure 1:
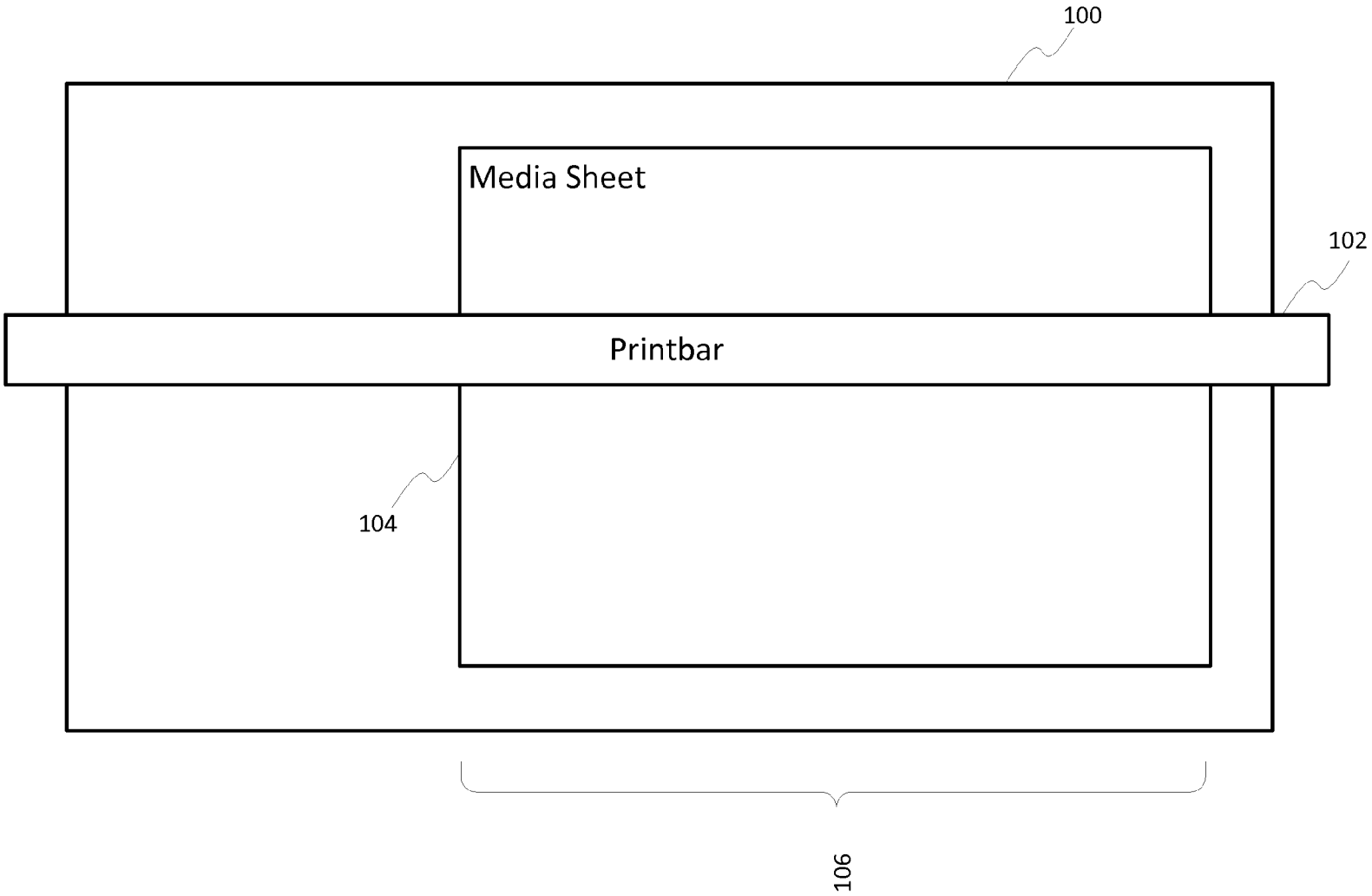
FIG. 1 illustrates an inkjet printer having a printbar with a first size of print media.

FIG. 1 illustrates a PWA printer 100 with a printbar 102, in which a first media sheet 104 is loaded for printing. The first media sheet is narrower than the total printer width, and hence only a portion of the nozzles of the Page Wide Array printbar 102 are used in printing to the first media sheet 104. This results in usage of nozzles within area 106 while nozzles in other areas of the printbar are unused. Repeated printing to first media sheets results in uneven nozzle usage across the printbar, with nozzles in the area 106 experiencing much greater usage.

Figure 2:
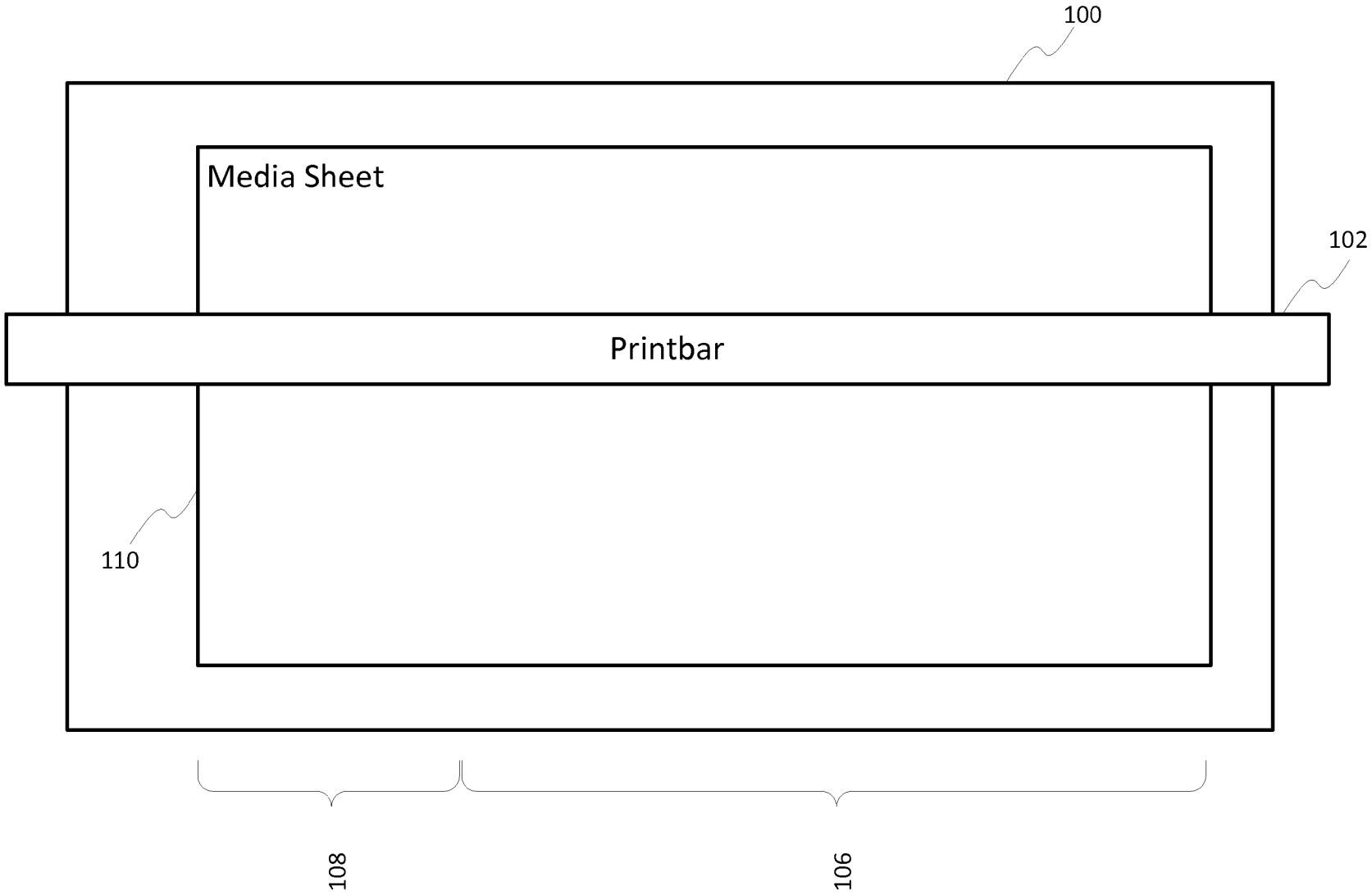
FIG. 2 illustrates the inkjet printer of FIG. 1 with a second, larger, size of print media

FIG. 2 illustrates the printer 100 of FIG. 1 with a second, larger, media sheet 110 loaded for printing. If the larger media sheet 110 is loaded subsequent to printing multiple pages using the smaller media sheet 104, nozzles in region 106 will have experienced greater usage than the nozzles in region 108 of the printbar. As higher usage leads to smaller ink drops being ejected from the nozzles in region 106, printing to the larger sheet will result in the portion of the media sheet 110 printed using nozzles in region 106 being lighter in color than the portion of the media sheet 110 printed using the nozzles in region 108. This difference appears as banding in the final image.

One prior approach to limit banding caused in this way is to perform a calibration procedure for the printbar whenever a different size of media is loaded. However, this entails an increase of media waste and a customer perception of unreliability. According to this approach, color calibration must be performed on a regular basis in order to prevent the growth of banding artifacts in the printed media.

Another solution has been to use laterally moving printbars (or indexing printbars) when printing successive pages. This spreads the uneven usage of nozzles across regions of a printbar, instead of forming a well-defined step. However, the use of laterally moving printbars increases the cost and complexity of the printer, and still results in a color difference between the center and edges of the printed image.

According to some examples, the printer 100 of FIGS. 1 and 2 predicts the parameters needed to maintain color calibration for nozzles in different regions of the printbar 102 by monitoring the ink quantity fired by nozzles since the last color calibration process was performed, for example by maintaining a count of nozzle activations. The number of activations of each nozzle can then be combined with historical data to predict a corrected color calibration at a later time, without the need to perform a further calibration procedure. This allows a greater period of time to elapse between calibration procedures being performed before visible printing artifacts can be expected to appear in printed media.

Figure 3:
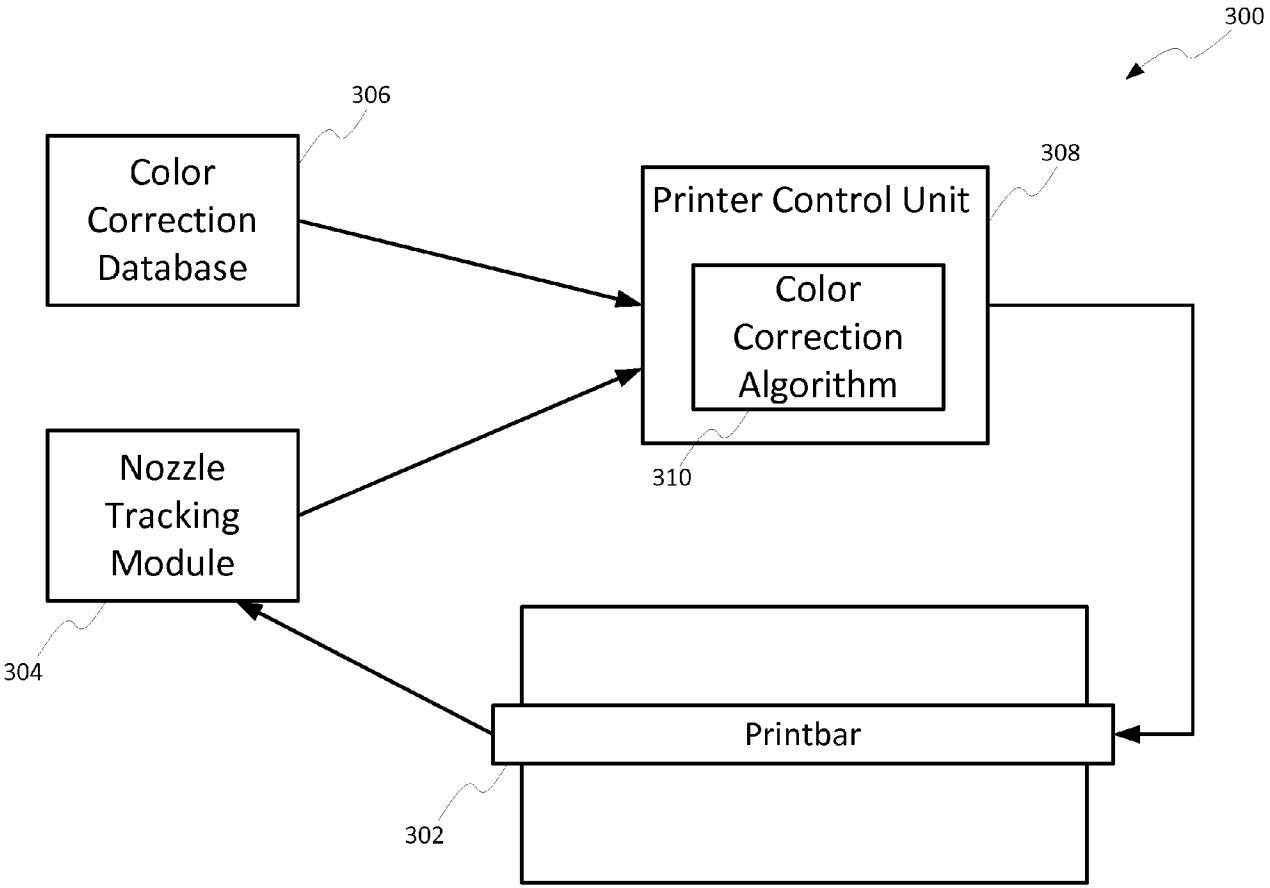
FIG. 3 illustrates a block diagram of an inkjet printer.

FIG. 3 illustrates a block diagram of a PWA printer 300. The printer 300 comprises a printer control unit 308 that provides control information to a printbar 302 to control when drops of ink are to be ejected from individual nozzles in the page wide array. The printer control unit includes a color correction algorithm 310 that adjusts the control information provided to the nozzles based on stored calibration data to ensure consistent color reproduction for portions of the image printed by each of the nozzles. A nozzle tracking module 304 is coupled to the printbar 302 to maintain a count of nozzle activations which is provided to the printer control unit 308 for use in the color correction algorithm 310. Historical calibration information is stored in a color correction database 306.

In operation, nozzle usage per printbar region is tracked by means of a nozzle counting system and a database which form the nozzle tracking module 304. The printer control unit 308 uses the data stored in the nozzle tracking module 304 to track the nozzle usage per region since the last color calibration process was performed. Based on that information, and on the historical calibration information stored in the color correction database 306, the printer control unit 308 calculates an updated set of parameters for the color calibration algorithm 310. Thus, the printer control unit 308 is able to predict changes in drop weight or color calibration for nozzles or regions of nozzles based on nozzle usage, and correct for any predicted changes by modifying the parameters of the color correction algorithm 310. As a result, printing artifacts due to nozzle usage may be reduced, even when a larger print media 110 is loaded into the printer 300.

The historical calibration information stored in the color correction database is generated by recording how color calibration values have changed between previous calibration processes being performed compared with nozzle usage. For example, a ramp of color patches, from white to ink-saturated values, can be printed for each ink in the printer. This allows a relationship between the color output, e.g. drop weight, versus color input to be determined for the nozzles. Based on that relationship, a calibration curve is determined so that the printer behaves consistently.

Figure 4:
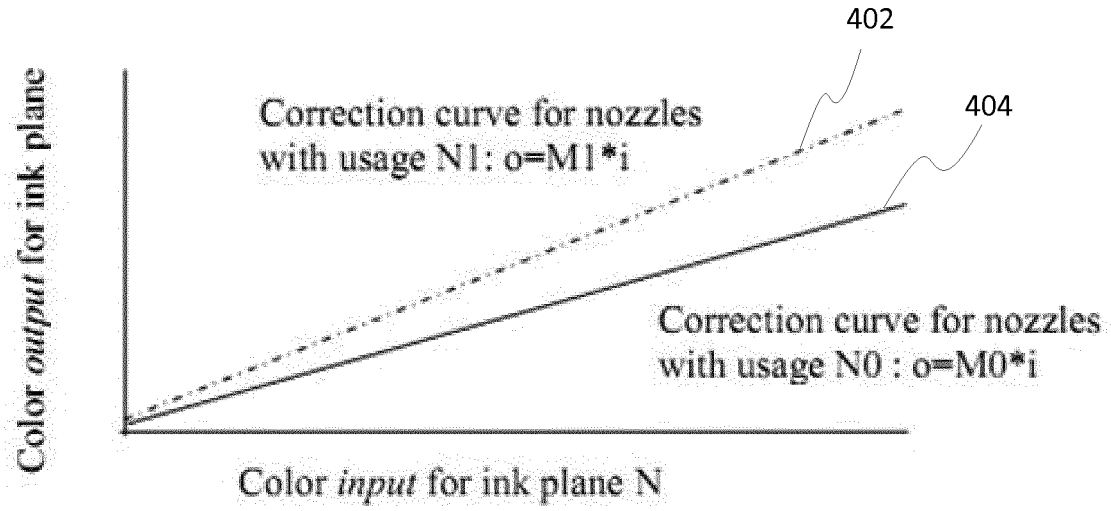
FIG. 4 is an example calibration curve for nozzles having high and low nozzle usage.

FIG. 4 shows two calibration curves 402, 404, one for nozzles with low usage N0 and others with high usage N1. As discussed above, the drop weight from each nozzle tends to reduce with higher usage, and this is compensated with a steeper calibration curve 404. The color correction database contains statistics on the dependency of color calibration versus nozzle usage. For the example shown in FIG. 4, it contains a function describing the average of change of slope M versus nozzle usage. Such information is used to update the color calibration algorithm 310 of the printer 300.

The color correction database 306 can be located within the printer 300, or may be located in a server and communicate via a network. Depending on its implementation, the color correction database 306 may contain only data relative to a single printer 300, or data obtained from a pool of similar printers. In some examples, the color correction database 306 may contain fixed statistical data generated during the printer design process, or determined in advance from testing of a small number of representative sample printers.

Other information may be taken into account when determining the color calibration parameters to be used to offset changes due to nozzle usage. For example, the ink manufacturing batch may be considered as a factor. This is because it has been observed that different batches of ink may affect nozzles to differing extents. Furthermore, different calibration information may be stored in the color calibration database for different types or batches of ink, to allow the effects of different inks on the changes in nozzle calibration with nozzle usage to be taken into account.

Figure 5:
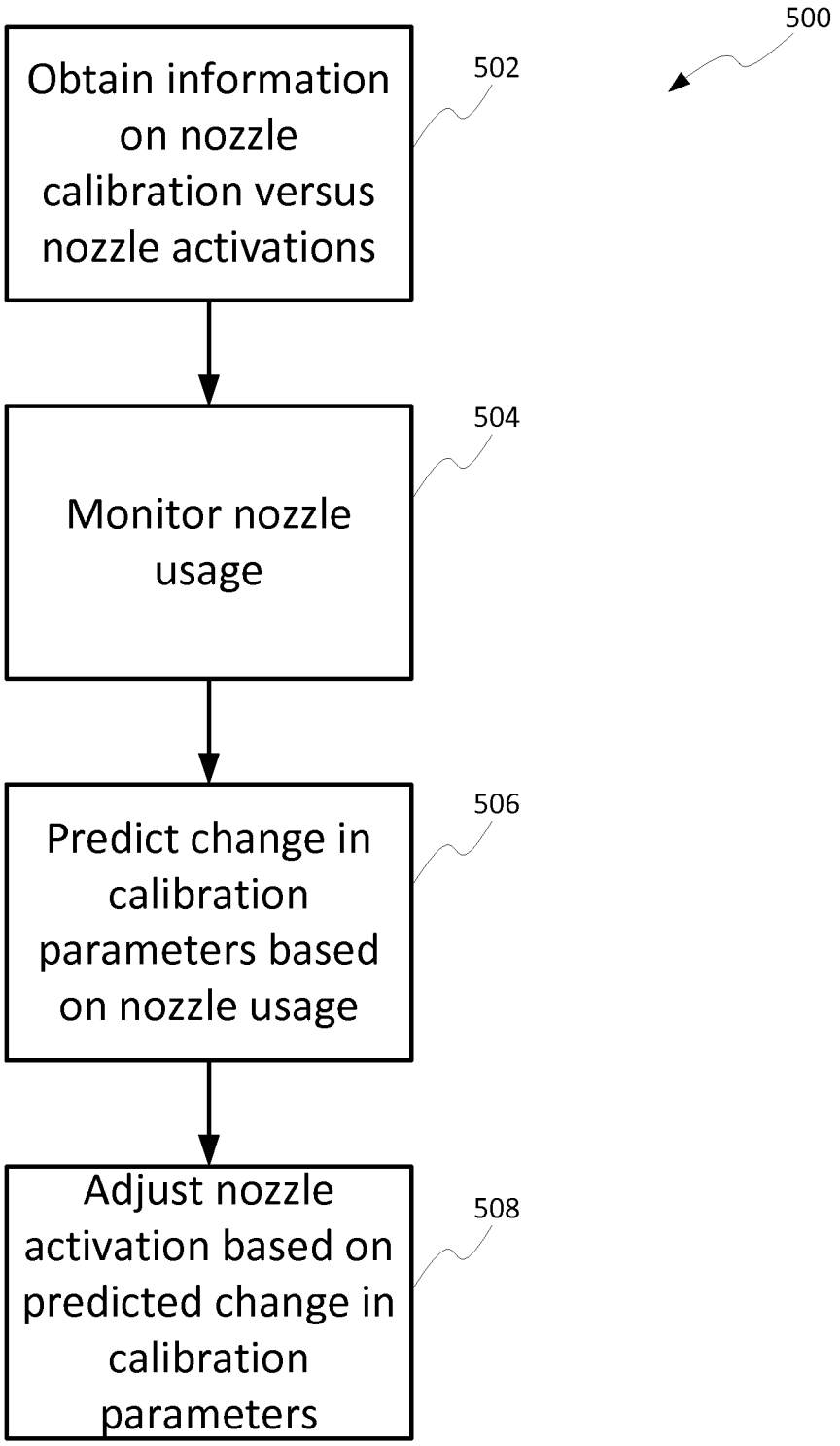
FIG. 5 illustrates a method of calibration of inkjet nozzles.

FIG. 5 illustrates a method of maintaining calibration accuracy of nozzles between performing calibration processes according to examples. According to the method 500 of FIG. 5, in a first stage 502 information such as statistical data is obtained that defines how calibration parameters associated with a nozzle change with nozzle usage. During operation of a printer, nozzle usage for the inkjet nozzles being used to print an image to a print medium is monitored in stage 504. In stage 506, the nozzle usage information is then used in conjunction with the information defining the relationship between nozzle usage and calibration parameters associated with a nozzle to predict how calibration parameters for the nozzles are changing with use. This predicted change can then be used to adjust nozzle activations, either directly or by appropriate adjustment of the image date, to ensure consistent color reproduction throughout the printed image regardless of differences in nozzle usage for different groups of nozzles (e.g. nozzles in areas 106 and 108 in FIG. 2) on the printbar 302 in stage 508.

While in general it is sufficient to monitor groups or regions on nozzles on the printbar and adjust calibration settings for all nozzles within that region based on average nozzle usage for the region, in other examples it may be preferable to monitor nozzles relating to a single die that forms part of the page wide nozzle array, or even to monitor individual nozzles.

As discussed above, PWA printers may be particular susceptible to banding artifacts caused by different nozzle usage for different regions of a printbar. Therefore examples may be particularly suited to use in PWA printers to allow calibration of different nozzles or regions of nozzles to be maintained without requiring more frequency calibration processes to be performed. Thus, examples may result in less print media being wasted, and an improved user experience. Furthermore, it is possible to avoid the complexity of indexing printbars while providing the capability to correct color variations, rather than simply hide them as with traditional indexing printbars.

While examples have been described in the context of a PWA printer, other examples may be suited to use with scanned printers.

In the above disclosure, the determination of calibration parameters for the nozzles has been discussed. The person skilled in the art will understand that the application of the calibration parameters may take the form of a mathematical procedure (such as an algorithm or Look-Up-Table) applied to data representing image color or a quantity of ink to be applied for a pixel. Alternatively, the calibration parameters may affect physical control signals applied to a specific nozzle, for example a voltage, time or intensity of a control signal applied to a nozzle.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method of generating calibration parameters for an inkjet nozzle, the method comprising:

obtaining data defining how calibration parameters associated with an inkjet nozzle change as the number of ink drops ejected from a nozzle increases;

determining a number of ink drops ejected from the nozzle; and adjusting calibration parameters associated with the nozzle based on the determined number of ink drops ejected from the nozzle and the obtained data defining how calibration parameters associated with the nozzle change as the number of ink drops ejected from a nozzle increases;

wherein obtaining data defining how calibration parameters associated with the nozzle change as the number of ink drops ejected from a nozzle increases comprises determining a change in calibration parameters and a number of ink drops ejected from the nozzle between calibration processes being performed.

2. The method of claim 1, wherein the inkjet nozzle comprises one of a plurality of ink jet nozzles on a print bar in a Page Wide Array printer.

3. The method of claim 2, wherein determining a number of ink drops ejected from the nozzle comprises determining a number of ink drops ejected from a plurality of neighbouring nozzles on the printbar, and wherein calculating calibration parameters for the nozzle comprises calculating calibration parameters for the plurality of neighbouring nozzles.

4. The method of claim 1, wherein obtaining data defining how calibration parameters associated with the nozzle change as the number of ink drops ejected from a nozzle increases comprises obtaining statistical data relating to changes in calibration parameters as the number of ink drops ejected from a nozzle increases.

5. The method of claim 4, wherein the statistical data is determined from design information, or wherein the statistical data is captured from a plurality of printing devices.

6. The method of claim 1, wherein the calibration parameters associated with the nozzle are adjusted such that the drop size of ink drops ejected from the nozzle remains constant.

7. The method of claim 1, wherein the calibration parameters associated with the nozzle are adjusted such that the number of ink drops deposited on a pixel for a desired ink density increases as the number of ink drops ejected from the nozzle increases.

8. An printing apparatus comprising:

at least one inkjet nozzle;

a nozzle usage tracking module configured to determine a number of ink drops ejected from the at least one inkjet nozzle;

a controller operable to adjust calibration parameters for the at least one inkjet nozzle based on the number of ink drops ejected from the at least one inkjet nozzle and on data defining how calibration parameters associated with the nozzle change as the number of ink drops ejected from the at least one nozzle increase;

wherein the controller is further operable to cause a calibration process to be performed for the at least one nozzle, and wherein the nozzle usage tracking module is configured to determine a number of ink drops ejected from the at least one inkjet nozzle since a last calibration process was performed, wherein the data defining how calibration parameters associated with the nozzle change is obtained based on changes in calibration parameters during a calibration process and on the number of ink drops ejected from the at least one inkjet nozzle since a last calibration process was performed.

9. The apparatus of claim 8, wherein the printing apparatus is a Page Wide Array printer comprising a printbar and wherein the at least one nozzle comprises a plurality of nozzles disposed on the printbar.

10. The apparatus of claim 9, wherein the plurality of nozzles are located within a region of the printbar.

11. The apparatus of claim 8, further comprising a color correction database configured to store data defining how calibration parameters associated with the nozzle change as the number of ink drops ejected from the at least one nozzle increases.

12. The apparatus of claim 8, wherein the controller is operable to adjust the calibration parameters associated with the nozzle such that the drop size of ink drops ejected from the nozzle remains constant.

13. A non-transitory computer program product comprising computer program code configured when executed on a processor to perform the steps of:

obtaining data defining how calibration parameters associated with the nozzle change as the number of ink drops ejected from a nozzle increases;

determining a number of ink drops ejected from the nozzle; and calculating calibration parameters for the nozzle based on the determined number of ink drops ejected from the nozzle and the obtained data defining how calibration parameters associated with the nozzle change as the number of ink drops ejected from a nozzle increases;

wherein obtaining data defining how calibration parameters associated with the nozzle change as the number of ink drops ejected from a nozzle increases comprises determining a change in calibration parameters and a number of ink drops elected from the nozzle between calibration processes being performed.

14. A method of generating calibration parameters for an inkjet nozzle, the method comprising:

obtaining data defining how calibration parameters associated with an inkjet nozzle change as the number of ink drops ejected from a nozzle increases;

determining a number of ink drops ejected from the nozzle; and adjusting calibration parameters associated with the nozzle based on the determined number of ink drops ejected from the nozzle and the obtained data defining how calibration parameters associated with the nozzle change as the number of ink drops ejected from a nozzle increases;

wherein the calibration parameters associated with the nozzle are adjusted such that the number of ink drops deposited on a pixel for a desired ink density increases as the number of ink drops ejected from the nozzle increases.

* * * * *